US007517479B2

(12) United States Patent
Bango et al.

(10) Patent No.: US 7,517,479 B2
(45) Date of Patent: Apr. 14, 2009

(54) METHOD OF UTILIZING MEMS BASED DEVICES TO PRODUCE ELECTROSPUN FIBERS FOR COMMERCIAL, INDUSTRIAL AND MEDICAL USE

(76) Inventors: Joseph J. Bango, 40 Alston Ave., New Haven, CT (US) 06515; Michael E. Dziekan, 1081 New Haven Rd., Unit 10-I, Naugatuck, CT (US) 06770

( * ) Notice: Subject to any disclaimer, the term of this patent is extended or adjusted under 35 U.S.C. 154(b) by 711 days.

(21) Appl. No.: 11/004,149

(22) Filed: Dec. 3, 2004

(65) Prior Publication Data

US 2005/0121470 A1 Jun. 9, 2005

Related U.S. Application Data

(60) Provisional application No. 60/526,879, filed on Dec. 4, 2003.

(51) Int. Cl.
*B29B 9/06* (2006.01)
*B29C 67/00* (2006.01)
*B29C 47/08* (2006.01)

(52) U.S. Cl. ..... 264/10; 264/441; 264/460; 264/465

(58) Field of Classification Search ..... 264/10, 264/115, 211.17, 437–441, 460, 465, 81; 425/81, 66, 174.8 E, 174.8 R, 382.2, 382.3, 425/464

See application file for complete search history.

(56) References Cited

U.S. PATENT DOCUMENTS

| | | | | |
|---|---|---|---|---|
| 4,323,525 | A * | 4/1982 | Bornat | 264/441 |
| 6,110,590 | A * | 8/2000 | Zarkoob et al. | 428/364 |
| 6,297,499 | B1 * | 10/2001 | Fenn | 250/288 |
| 6,670,607 | B2 * | 12/2003 | Wood et al. | 250/288 |
| 6,743,273 | B2 * | 6/2004 | Chung et al. | 55/482 |
| 6,800,117 | B2 * | 10/2004 | Barris et al. | 95/273 |
| 6,924,028 | B2 * | 8/2005 | Chung et al. | 428/357 |
| 6,955,775 | B2 * | 10/2005 | Chung et al. | 264/10 |
| 7,070,640 | B2 * | 7/2006 | Chung et al. | 55/487 |
| 7,134,857 | B2 * | 11/2006 | Andrady et al. | 425/66 |
| 7,179,317 | B2 * | 2/2007 | Chung et al. | 55/528 |
| 2002/0007869 | A1 * | 1/2002 | Pui et al. | 141/173 |
| 2002/0122840 | A1 * | 9/2002 | Lee et al. | 425/174.6 |
| 2002/0192468 | A1 * | 12/2002 | Choi | 428/392 |
| 2003/0106294 | A1 * | 6/2003 | Chung et al. | 55/486 |

* cited by examiner

*Primary Examiner*—Philip C Tucker
*Assistant Examiner*—Sing P Chan
(74) *Attorney, Agent, or Firm*—James F. Kirk

(57) ABSTRACT

A method of fiber production relating in general to electrospinning and specifically to MEMS (Micro ElectroMechanical Structures). Utilizing integrated circuit manufacturing processes, a nanoscale, self-contained device has been developed to execute the process of electrospinning large arrays of fibers and fiber arrays. One of the benefits of using the disclosed MEMS device is that the voltage required to produce a "so called" Taylor Cone would is substantially reduced and the requirement of a hydrostatic feed negated through the use of passive capillarity based wick surface treatment.

14 Claims, 6 Drawing Sheets

METHOD OF UTILIZING MEMS BASED DEVICES TO PRODUCE ELECTROSPUN FIBERS FOR COMMERCIAL, INDUSTRIAL AND MEDICAL USE

CROSS REFERENCE TO RELATED APPLICATIONS

Provisional Application No. 60/526879 was filed on 4 Dec. 2003

BACKGROUND

1. Field of Invention

This method of fiber production relates in general to electrospinning and specifically to MEMS (Micro Electro Mechanical Structures). Using current integrated circuit manufacturing processes, it is feasible that a tiny, compact, self-contained device could be constructed to carry out the process of electrospinning fibers. One of the great benefits of using a MEMS device is that the voltage required to produce a "so called" Taylor Cone would be substantially reduced, and the hydrostatic feed system could be incorporated into the MEMS device through the use of passive wick technology. The incorporation of holey fibers into a MEMS device will also be discussed. The electrospray needle sources could be easily fabricated to produce co-axial arrangements to permit the electrospinning of two or more chemical compounds to form unique and complex fibers.

2. Background Description of Prior Art

There are several current methods of producing fibers for later use in various products; however, there is no easy way to mechanically produce microfibers ($10^{-6}$ m mean diameter) and even smaller nanofibers ($10^{-9}$ m mean diameter). The microfibers are fibers with a mean diameter of millionths of a meter (um) and the nanofibers are fibers with a mean diameter of billionths of a meter (nm). To give an example of how small that is, a standard sheet of printer paper has an average thickness of about 0.003" or 0.0762 mm, which is equal to 76.2 μm and 76,200 nm. The wavelength of red light is equal to approx. 690 nm. It is all but impossible to construct a mechanical means or spinning a fiber that has a mean diameter of micrometers, let alone nano-meters! One simple way to do this impossible feat is to use the proven technology of electrospray. Through the use of electrospray technology incorporated into a MEMS device, it is possible to produce an extremely fine fiber that meets this criterion of producing micrometer and nanometer sized diameters.

DETAILED DESCRIPTION OF THE INVENTION

Figure 1:
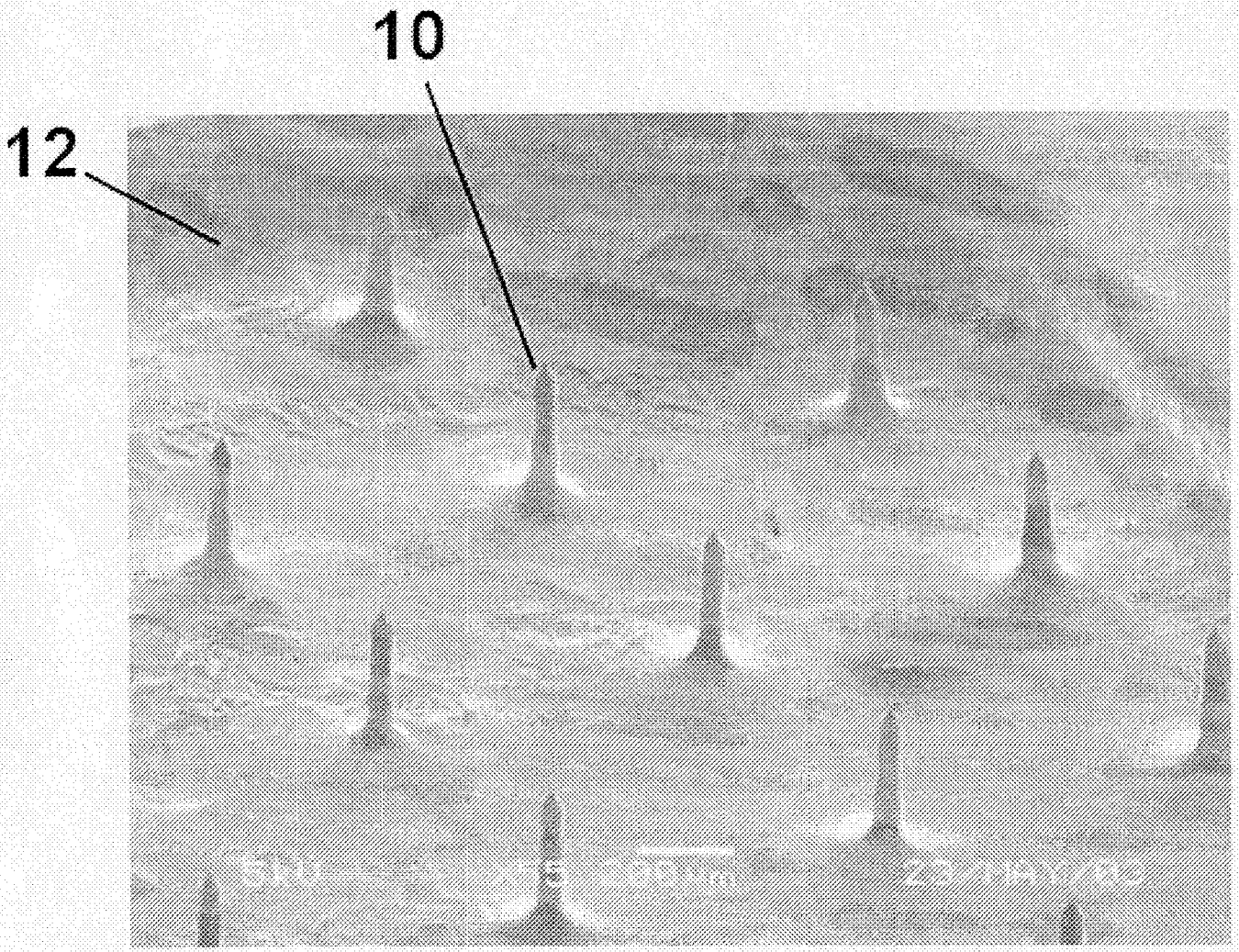
FIG. 1 shows a SEM (Scanning Electron Microscope) picture or micrograph of a small array of electrospray needles that will be externally wetted to permit electrospraying.

Electrostatic fiber spinning, or "electrospinning," is a technology that uses electric fields to produce nonwoven materials which are unparalleled in their porosity, high surface area, and the fineness and uniformity of their fibers. The diameters of electrospun fibers are typically hundreds of nano-meters, one to two orders of magnitude smaller than fibers produced by conventional extrusion techniques. These fibers are attracting considerable interest in a wide range of applications, including filters, membranes, composites and biomimetic materials. Despite this surge in interest, the essential features of the process responsible for the formation of such fine fibers have proved elusive to both scientific understanding and engineering control.

Typically the sub-micron diameter fibers are produced from an aqueous solution by electrospinning and collected as a nonwoven fabric when a charged fluid jet is accelerated down an electric field gradient, solidified, and deposited onto a grounded collector. Similar fibers have been manufactured from over 30 different kinds of polymers in recent years. By contrast, synthetic polymer fibers produced by conventional extrusion-and-drawing processes are typically 10 um to 500 um in diameter, and are collected on spools for forming yarns or woven textiles. Controlling the fiber properties requires understanding how the electrospinning process transforms a millimeter-diameter fluid stream into solid fibers four orders of magnitude smaller in diameter. In the conventional view, electrostatic charging of the fluid at the tip of a nozzle results in the formation of the well-known Taylor cone, from the apex of which a single fluid jet is ejected. As the jet accelerates and thins in the electric field, radial charge repulsion results in "whipping about" of the jet, in a process known as "splaying." The final fiber size is determined by several factors, such as the electrospray voltage, concentration of solvent to solute, and distance to target. During electrospinning it is normal for the rapid growth of a nonaxisymmetric, or "whipping," instability that causes bending and stretching of the jet. At low fields, the jet uniformly thins and extends from the nozzle to the collector, while at high fields, and after traveling a short distance, the jet becomes unstable and "whips about". The use of MEMS devices will enable an effective low field electrospray to be used for electrospinning. An effective means of controlling the "whipping" instability has already been addressed by Dr. John B. Fenn. Dr. Fenn is considered to be an "elder" in the area of electrospray research, and recently won the 2002 Nobel Prize in Chemistry for his pioneering work in electrospray. He is regarded as the "E. F. Hutton" of electrospray—when he speaks, everyone listens! Dr. Fenns idea was to use an alternating voltage at the source to prevent charge buildup on individual fibers. This prevents the typical non-uniform distribution in the laying of electrospun fibers. With the use of tiny MEMS devices, the lower field will enable stable fibers that will not be affected by any "whipping" instability. Another innovation in the field of electrospray and electrospinning technology that was made by Dr. John B. Fenn was to use a "wick" in place of a costly hydrostatic feed pump. The wick is a self-regulating liquid feed system with no moving parts, and can accurately control picoliters ($10^{-12}$ L) of fluid. The wick used for electrospray and electrospinning applications could be an internal one or an external one. If an internal wick is used, then the wicking material would have to be enclosed into a needle or some structural material to hold it. This is very difficult when dealing with needles that have diameters in the micrometer range. A better solution would be to use a recent discovery of utilizing special glass optical fibers that contain tiny holes running the length of the fiber, known as "Holey Fibers". These holey fibers could contain upwards of 200 holes with hole diameters ranging from sub-micron sizes to tens of microns. Together with a suitable MEMS device, single holey fibers or a plurality of holey fibers could facilitate the electrospinning process. When dealing with an externally wetted wick, no actual wicking material is used; the treated surface of a small needle will function adequately. The MEMS devices will benefit greatly from this technology. While the preferred embodiment is a surface that has been treated so as to form a rough surface that can "wick" a solvent-polymer combination, patent priority extends to a MEMS device where nano nozzles are created in which the solvent-polymer solution is delivered via a hydrostatic feed mechanism. The nano fluidic prior art includes nano spray nozzles that have been developed that are hydrostatically fed for electrospray analytical applications, but not for the electrospinning application as disclosed in this patent disclosure.

To recap the electrospinning process, a polymer, in this case example collagen is dissolved by a suitable solvent and injected under hydrostatic pressure into a conductive needle or capillary. A DC potential of preferably 500 to 1,000 volts, which can be greater or lower than this value depending on the spray source to target gap, is maintained between the electrospray source and a suitable target located at a distance away from the needle sufficient to preclude production of a corona or arc. The voltage is adjusted according the distance, desired fiber diameter and structure. Voltage difference between injection needle and target suited to the given solvent conductivity, polymer, and flow rate, enable a resulting electrostatic field at the needle tip that results in the formation of a Taylor Cone from the tip which issues a micron sized jet diameter which is attracted to, and impacts with, the ground cathode target. Evaporation of solvent from this jet results in a polymer strand of collagen or other polymer. The accumulation of such strands creates a "mat" of polymer having a homogenous diameter ranging from tens of microns or more down to tens of nanometers or less, depending on the concentration and nature of solute, the conductivity and viscosity of liquid, and the potential difference between the needle and target. It has been shown by Wnek et al. of Virginia Commonwealth University (VCU), that electrospun collagen fibers can be produced down to 100 (+/−40) nano meters in diameter. Calf skin dissolved in a suitable solvent was electrospun, and upon Transmission Electron Microscopy (TEM) examination, revealed the same banded appearance characteristic of native polymerized collagen. Various polymers studied yielded fiber diameters in the range of 0.1 to 10 um. It should be noted that nano-extrusion rather than electrospinning of the polymer are an alternative in certain instances.

Polymer mats produced by this process can have diameters up to tens of microns and thickness of up to hundreds of microns, depending on deposition time. Similarly, it has been found that polymers such as collagen for creating a suitable corneal mat as part of this invention can be derived from a variety of sources. In the preferred embodiment, synthetic collagen such as that manufactured by FibroGen of San Francisco, Calif., is dissolved by a solvent such as 1,1,1,3,3,3 hexaflouro-2-propanol (HFIPA) and electrospun into a fibril diameter of preferably 65 nanometers and spun into a mat that can be trimmed to desired final dimensions. Laser cutting or trimming is preferably employed since fibril terminations must be severed and should not be excessively frayed or tangled. Tangling or fraying can affect bonding to some surfaces. While the resulting polymer "mat" consists of disorganized fibrils, this disorganization can be remedied by using a varying polarity (AC) high voltage source in place of a constant DC potential in the spraying process.

FIG. 1 shows a two dimensional array of tiny etched needle emitters 10 formed into a silicon base 12. The main silicon housing contains the silicon base 12 is made by using standard integrated circuit techniques, and in this case was designed and fabricated by Manuel Martinez-Sanchez and Luis Velasquez of the Aeronautical and Astronautics Department of MIT as an electrospray emitter for space propulsion of nano satellites. In the MIT application, the spray is a liquid source that produces colloidal droplets that are ejected at high velocity from the MEMS surface. The surface of the silicon device was plasma etched to create a rough topography where "wicking" of a suitable fluid could take place. When the MEMS electrospray emitters (etched needles 10) were treated with a solution of polymer and suitable solvent and a suitable electric field applied, nanofibers were produced with a density and degree of deposition control not possible heretofore this surprising result.

In the MIT lab for their nano thruster propulsion research, Dr. Martinez-Sanchez and Dr. Velasquez investigated the wetting properties of several materials such as bare Silicon (with various roughness'), Silicon Dioxide ($SiO_2$), Silicon Nitride ($Si_3N_4$), Aluminum and black Silicon to various ionic liquids. To modify the wetting properties of regular Silicon, MIT used a surface modification technique. Surface modification techniques can be of physical, chemical or radiative nature. In this case, plasma (radiative) was employed to modify the surface roughness and wetting energy. In particular, experiments proved most successful with black Silicon. Black Silicon results from exposing a regular Si wafer to a plasma dry etch with a chlorine chemistry. The end result is a strong roughening of the surface. The process is conformal, thus translating into good step coverage for microfabricated structures.

Figure 2B:
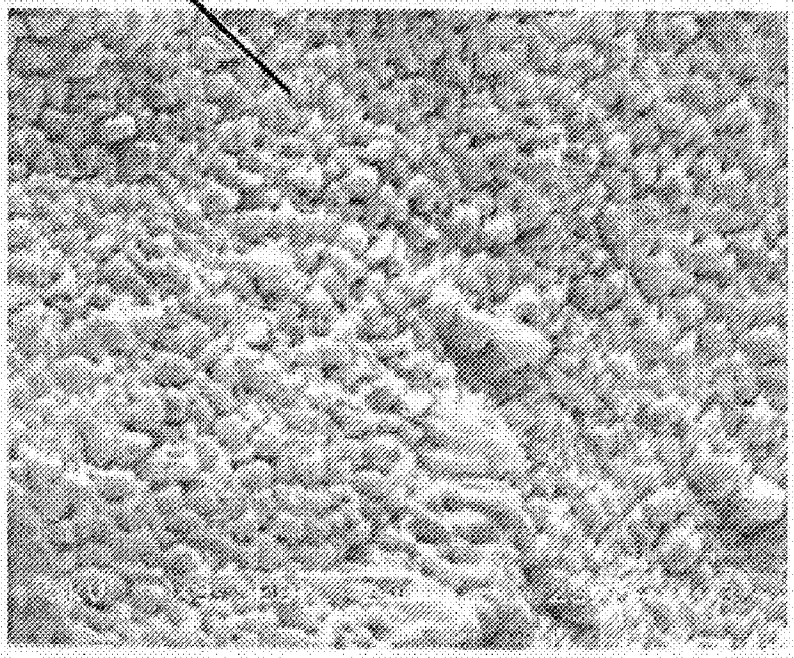
FIG. 2*b*: SEM (Scanning Electron Microscope) is a picture of black Si after being subjected to a 10 minute exposure to plasma.
Figure 2A:
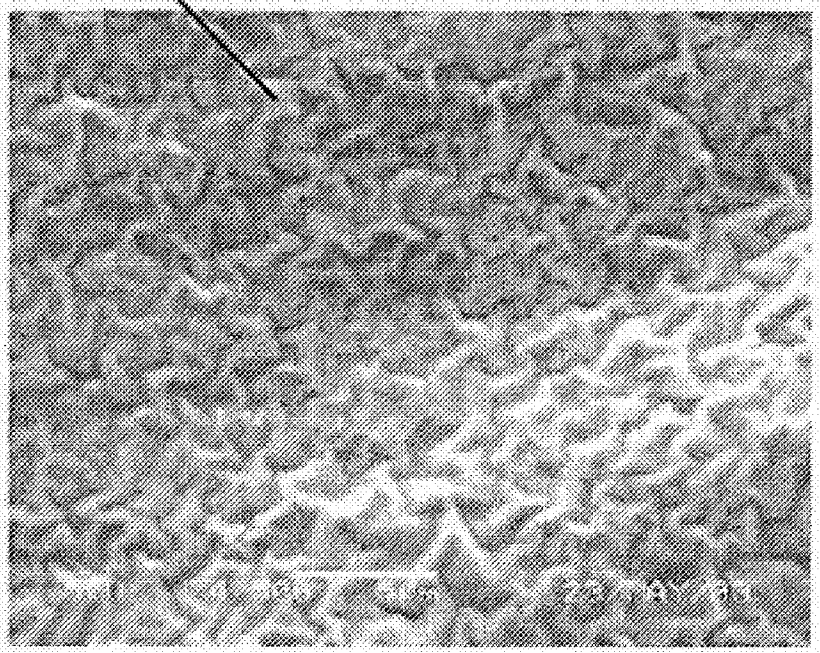
FIG. 2*a* SEM (Scanning Electron Microscope) is a picture of black Si after being subjected to a 5 minute exposure to plasma.

FIGS. 2*a* and 2*b* show two SEM (Scanning Electron Microscope) pictures of black Si. FIG. 2*a* on the left shows the result of a five minute plasma exposure to the region identified by reference identifier 14. FIG. 2*b* on the right shows the result of a ten minute plasma exposure to the region identified by reference identifier 16. The results from these first experimental experiences were incorporated into a second set of experiments. In this case we have a set of two-dimensional micofabricated protuberances covered by the porous black Si. The idea behind these experiments was to see how target fluids wetted the chip and if surface tension could drive the liquid to the top of the microfabricated columns.

Figure 3:
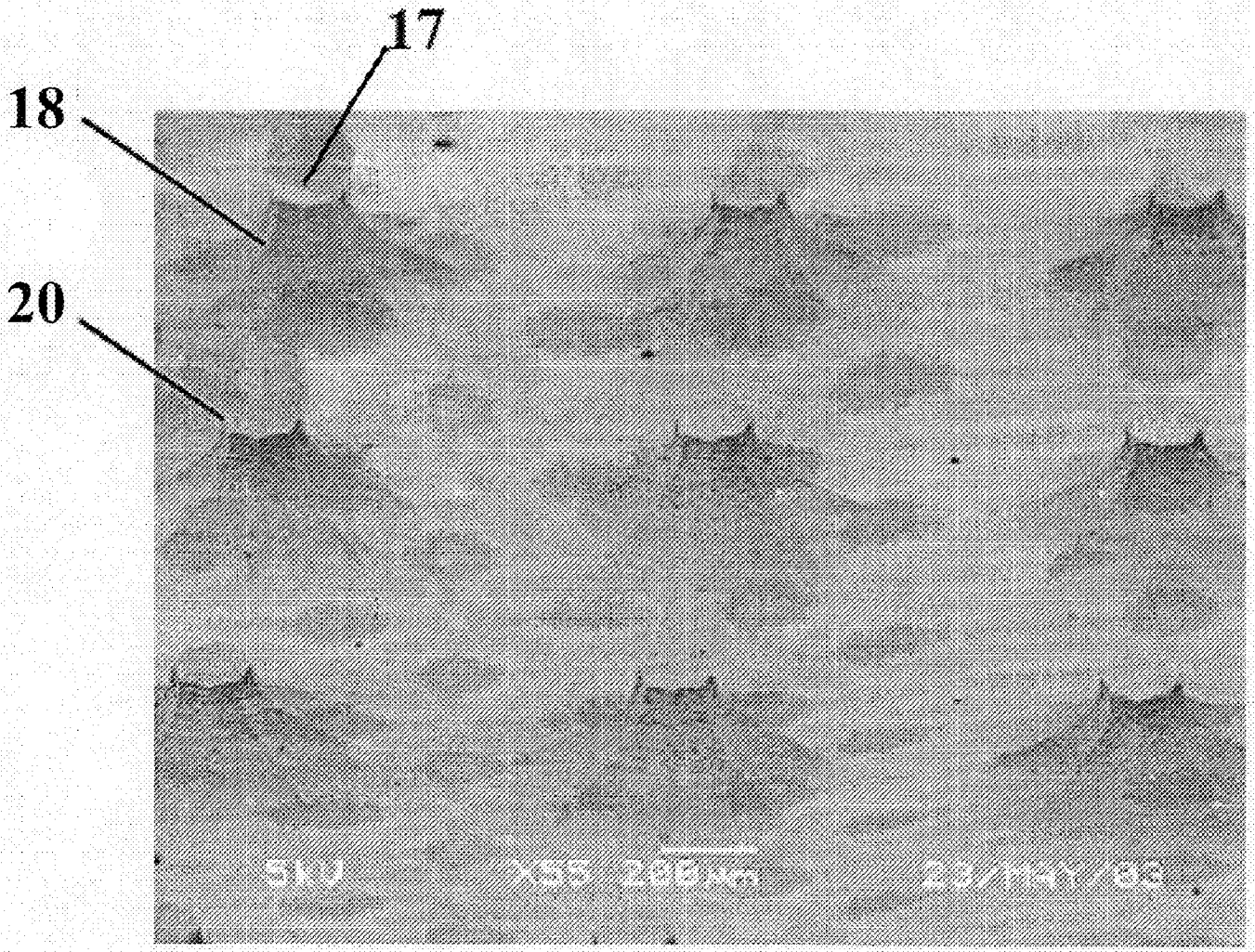
FIG. 3 shows a SEM (Scanning Electron Microscope) picture or micrograph of a small array of "volcano like" electrospray needles that will be externally wetted to permit electrospraying.

FIG. 3 details an array of "volcano like" emitters 17. The "volcano like" emitters have pointed octagonal edges 20 that are clearly visible. It is at these sharp interfaces where the "so called" Taylor cones will be formed. The details of the array of FIG. 3 are shown courtesy of M. Martinez-Sanchez, etched into the main silicon housing in a regular grid. The "volcano like" emitters would be "wetted" externally when an electrospinning solution is placed inside the main silicon housing and pulled up the individual emitter walls 18 by capillary action.

Figure 4:
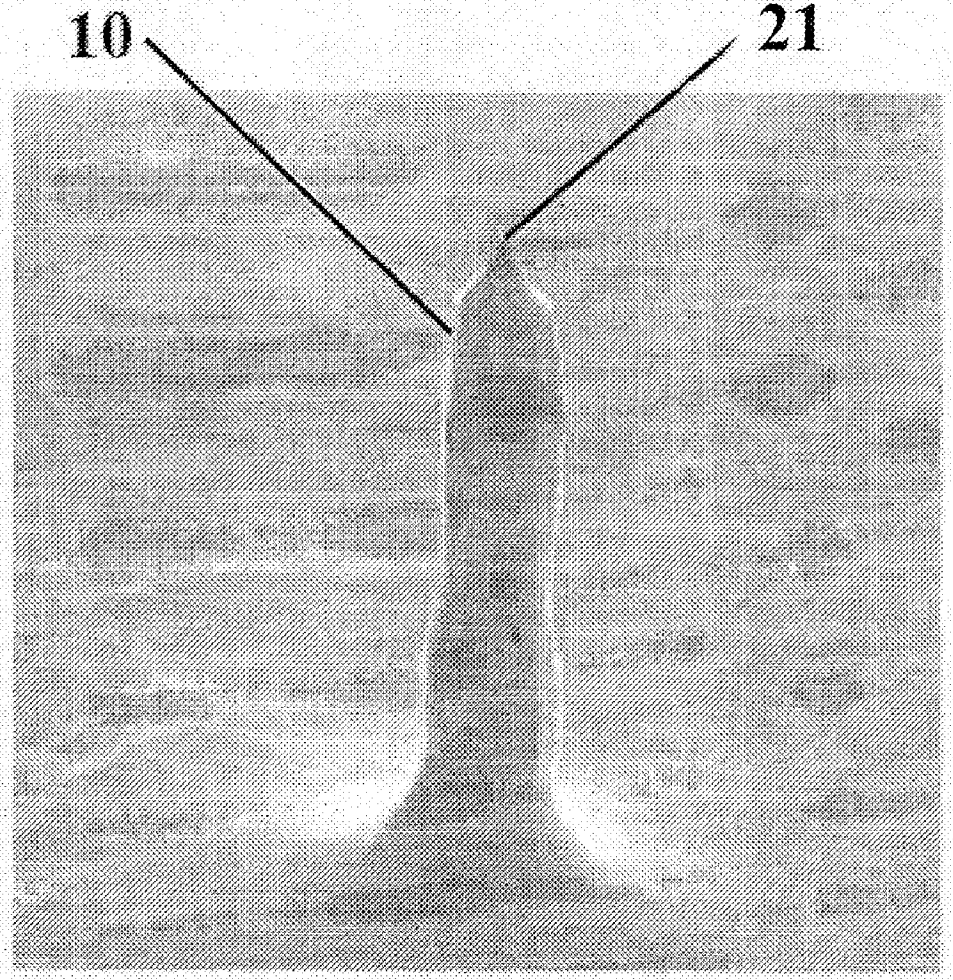
FIG. 4 shows a SEM micrograph detailing a close up view of a single needle source selected from those contained in the array of FIG. 1, FIG. 5: SEM (Scanning Electron Microscope) close-up of a single "Volcano-like" emitter selected from the array of emitters shown in FIG. 3, FIG. 6*a*: Shows SEM images of the microfabricated chip before wetting of polymer-solvent solution.

FIG. 4 details the structure of a single electrospray MEMS emitter or needle 10 selected from the array of needles shown in FIG. 1. The walls of each individual needle are nearly smooth, but not completely smooth. The walls have to be treated with a process to create a rough surface. This rough surface will then allow capillary action to "wick" up the solution to be electrosprayed and allow the electrospinning of fibers. The top of the tiny needle comes to a sharp point 21. This sharp point 21 concentrates the electric field to enable the formation of the "so called" Taylor cone. After the onset of the "so called" Taylor cone, a fine jet of liquid will be emitted from each individual tiny electrospray needle to form electrospun fibers after evaporation of the solvent. Evaporation of the polymer solvent can be increased by exposing the electrospinning apparatus to a partial pressure environment or by passing a drying gas between the electrospray MEMS emitter or needle or source 10 and target(not shown).

Figure 5:
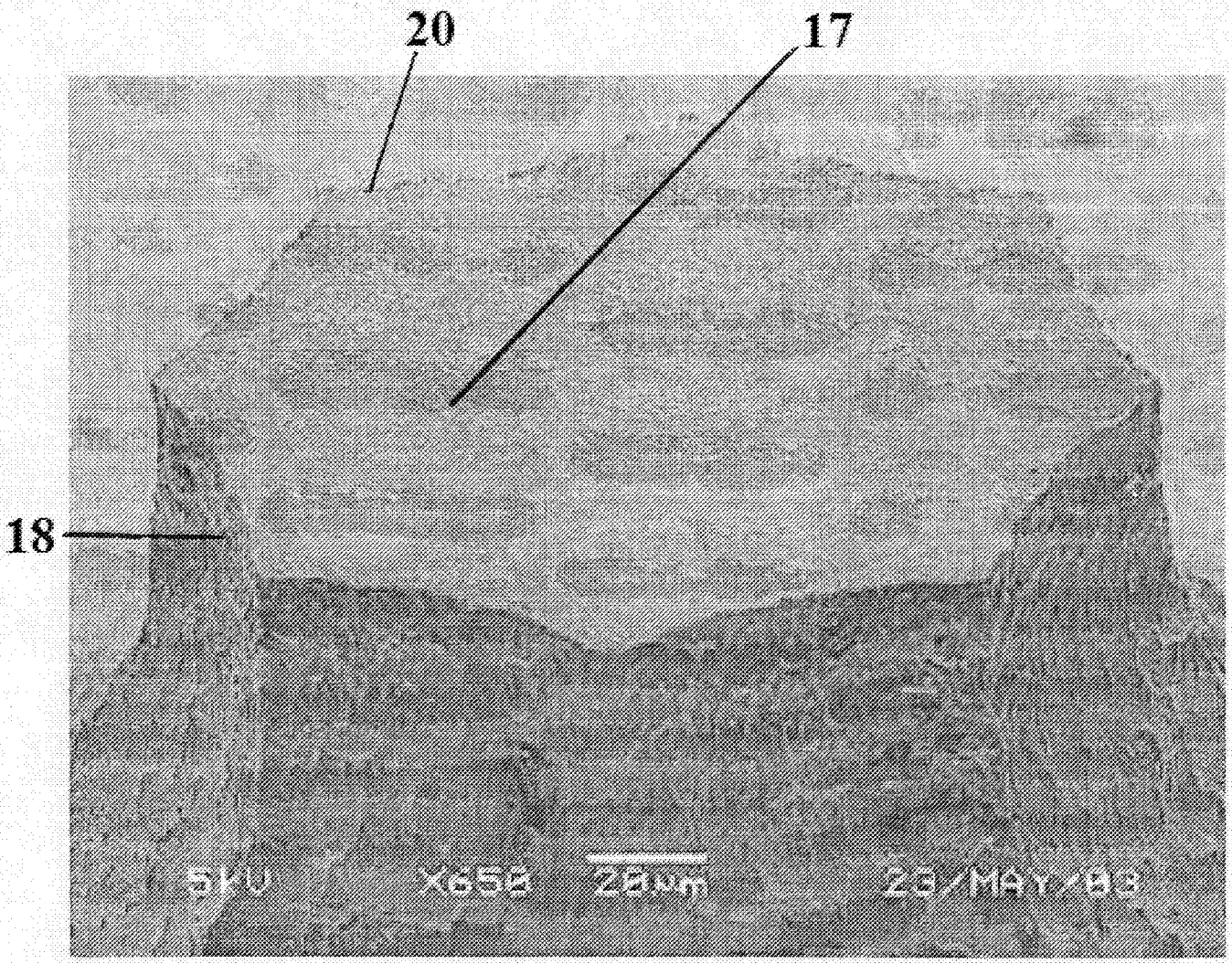

FIG. 5 shows a close up SEM (Scanning Electron Microscope) picture or micrograph of a single "volcano like" emitter 17. The pointed edges 20 are clearly visible. It is at these sharp interfaces where the "so called" Taylor cones will be formed. This type of "volcano like" electrospray emitter 17 will allow for eight individual jets for electrospinning to be produced at the same time. The total number of electrospray jets that could be produced would be equal to eight times the number of individual "volcano like" emitters 17. If there were one hundred individual "volcano like" emitters in the MEMS array, then the total number of electrospray jets would be eight hundred. This approach allows for the realization of large mats of uniform electrospun fibers to be created in a short amount of time.

Figure 6B:
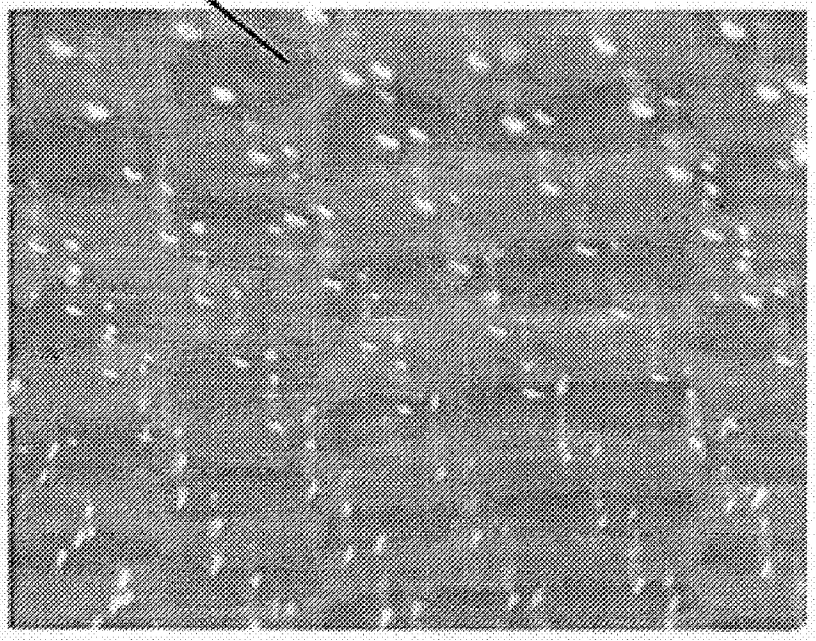
FIG. 6*b*: Shows SEM images of the microfabricated chip after wetting of polymer-solvent solution.
Figure 6A:
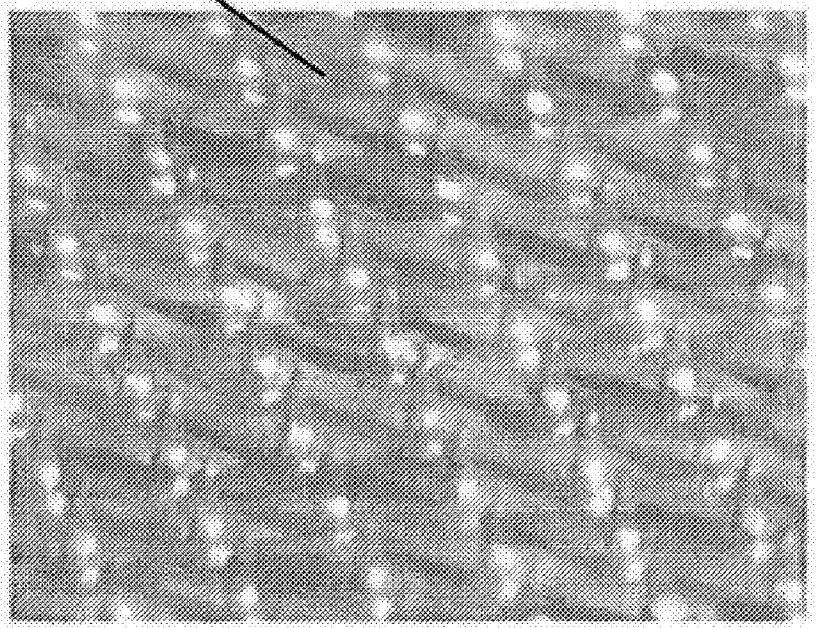

FIG. 6*a* shows a microfabricated MEMS chip 22 before wetting. FIG. 6*b* shows a microfabricated MEMS chip 24 after wetting. The image of FIG. 6*a* on the left shows the MEMS surface in its dry or non-wetted state. When a suitable electrospinning solution is placed on this surface, the treated silicon "wicks up" the liquid through capillary action. This provides a passive liquid transport mechanism to be realized for fluid delivery to each individual emitter.

REFERENCE NUMERALS

FIG. 1

Main structure of the silicon MEMS device housing a two dimensional array of electrospray needles, the etched emitters or needles 10 formed into a silicon base 12.

FIG. 2*a*

A black silicon SEM image 14 after five minutes of plasma exposure

FIG. 2*b*

A black silicon SEM image 16 after ten minutes of plasma exposure

FIG. 3

An SEM image of group of individual "volcano like" electrospray emitters 17, specifically the top corner where the electrospray would emanate from.

A sidewall 18 of treated silicon of a single "volcano like" electrospray emitter.

Pointed "volcano like" emitters have pointed octagonal edges 20 where the electrospray would emanate from.

FIG. 4

A close up view showing the structure of a single silicon electrospray needle 10 that makes up the MEMS array.

A close up view detailing the sharp pointed tip 21 of a single silicon electrospray needle.

FIG. 5

A SEM (Scanning Electron Microscope) close-up of "Volcano-like" emitter 17.

FIG. 6*a*

A SEM image of the microfabricated chip 22 with pointed "pencil like" emitters before wetting of polymer-solvent solution FIG. 6*b*

A SEM image of the microfabricated chip 24 with pointed "pencil like" emitters after wetting of polymer-solvent solution

We claim the following:

1. A method of making small diameter fibers by electrospinning comprising the steps of:

providing a MEMS (Micro Electro Mechanical Structures) device, having an array of electrospray conductive needles, formed on a base of conductive material, having conductive needles characterized to operate as individual electrospray emitters, each electrospray needle having a conductive needle tip, providing a conductive target having a flat target surface and an adjustable voltage source connected to apply voltage between the MEMS device and the conductive target, positioning the MEMS device electrospray needle tips to be in close parallel relation with the flat target surface, supplying a liquified fiber material to the base of conductive material, the liquefied fiber material wicking from the base to the conductive needle tips, adjusting the voltage source to form at least one Taylor cone extending from a conductive needle tip to the flat target surface.

2. The method of making small diameter fibers by electrospinning of claim 1 wherein the step of adjusting the voltage source to form at least one Taylor cone extending from a conductive needle tip to the flat target surface further comprises adjusting the position of the conductive needle tips with respect to the flat target surface to obtain a plurality of Taylor cones from two or more needle tips.

3. The method of making small diameter fibers by electrospinning of claim 2 wherein the step of adjusting the voltage source to form a plurality of Taylor cones further comprises adjusting the position and spacing of the conductive needle tips with respect to the flat target surface before adjusting the voltage source to form at least one Taylor cone extending from a needle tip to the flat target surface.

4. A method of making small diameter fibers by electrospinning using a MEMS device comprising the steps of:

providing a MEMS (Micro Electro Mechanical Structures) device, having an away of electrospray needles, formed on and from a base of conductive material, having needles characterized to operate as individual electrospray emitters, each electrospray needle having a needle tip, providing a conductive target having a flat target surface and an adjustable ac high-voltage source connected to apply voltage between the MEMS device and the conductive target, positioning the MEMS device electrospray needle tips to be in close parallel relation with the flat target surface, supplying a source of liquefied fiber material to the base of conductive material, the liquefied fiber material wicking from the base to the needle tips, coupling an ac high-voltage source between the conductive base and the flat target surface and adjusting the ac high-voltage source between the emitters and the flat target surface to form at least one Taylor cone extending from a needle tip to the flat target surface.

5. The method of making small diameter fibers by electrospinning of claim 4 wherein the step of adjusting the ac high-voltage source to form at least one Taylor cone extending from a needle tip to the flat target surface further comprises adjusting the position of the needle tips with respect to the flat target surface to obtain a plurality of Taylor cones from two or more needle tips and the concentration of the liquefied fiber material to solvent material to obtain solid fibers having diameters four orders of magnitude smaller than a one millimeter stream.

6. The method of making small diameter fibers by electrospinning of claim 4 wherein the step of adjusting the voltage source to form at least one Taylor cone extending from a needle tip to the flat target surface further comprises adjusting the position of the needle tips with respect to the flat target surface to obtain a plurality of Taylor cones from two or more needle tips.

7. The method of making small diameter fibers by electrospinning of claim 4 wherein the step of adjusting the voltage source to form a plurality of Taylor cones further comprises adjusting the position and spacing of the needle tips with respect to the flat target surface before adjusting the voltage source to form at least one Taylor cone extending from a needle tip to the flat target surface.

8. The method of making small diameter fibers by electrospinning of claim 4 wherein the step of providing a MEMS (Micro Electro Mechanical Structures) device, having a two dimensional away of electrospray needles, formed on a base of conductive material, having needles characterized to operate as individual electrospray emitters, each electrospray needle having a needle tip, the wetting characteristics of the surface being formed by exposing the individual electrospray emitters with a source of plasma to modify the surface roughness and thereby the wetting character of the surface.

9. The method of making small diameter fibers by electrospinning of claim 4 wherein the step of providing a MEMS (Micro Electro Mechanical Structures) device, having a two dimensional away of electrospray needles, formed on a base of conductive material further comprises the step of selecting the conductive material to be black Silicon that results from exposing a regular Si wafer to a plasma dry etch with a chlorine chemistry.

10. The method of making small diameter fibers by electrospinning of claim 4 wherein the step of supplying a source of liquefied fiber material to the base of conductive material, the liquefied fiber material wicking from the base to the needle tips further comprises the step of:

selecting the liquefied fiber material to be synthetic collagen dissolved by a solvent such as 1,1,1,3,3,3 hexaflouro-2-propanol (HFIPA) and electrospun into a fibril.

11. A method of making small diameter fibers by electrospinning comprising the steps of:

providing a MEMS (Micro Electro Mechanical Structures) device, having a two dimensional away of electrospray needles, formed on a base of conductive material, having needles characterized to operate as individual electrospray emitters, the electro spray needles, each electrospray needle having a needle tip, providing a conductive target having a flat target surface and an adjustable voltage source connected to apply voltage between the MEMS device and the conductive target, positioning the MEMS device electrospray needle tips to be in close parallel relation with the flat target surface, supplying a source of liquefied fiber material to the base of conductive material, the liquefied fiber material wicking from the base to the needle tips, adjusting a voltage source between the base of conductive material and the conductive target to form at least one Taylor cone extending from a needle tip to the flat target surface.

12. The method of making small diameter fibers by electrospinning of claim 11 wherein the step of supplying a source of liquefied fiber material to the base of conductive material, the liquefied fiber material wicking from the base to the needle tips further comprises the step of: selecting the liquefied fiber material to be synthetic collagen dissolved by a solvent such as 1,1,1,3,3,3 hexaflouro-2-propanol (HFIPA) and electro spun into a fibril.

13. The method of making small diameter fibers by electrospinning of claim 11 wherein the step of providing a MEMS (Micro Electro Mechanical Structures) device, having a two dimensional away of electrospray needles, formed on a base of conductive material, having needles characterized to operate as individual electrospray emitters further comprises:

forming an array of black silicon wafers on the base of a base of a black silicon die, using plasma etching, form a plurality of "volcano" emitters on each wafer on the base of the black silicon wafer die.

14. The method of making small diameter fibers by electrospinning of claim 11 wherein the step of providing a MEMS (Micro Electro Mechanical Structures) device, having a two dimensional away of electrospray needles, formed on a base of conductive material, having needles characterized to operate as individual electrospray emitters further comprises the step of:

making the MEMS device using conventional MEMS technology and locating the emitters for formation on the base of conductive material using photo-ithography followed by etching.

* * * * *